US005302151A

United States Patent [19]

Crouch

[11] Patent Number: 5,302,151

[45] Date of Patent: Apr. 12, 1994

[54] VARIABLE AIR FLOW EDDY CONTROL

[75] Inventor: Keith G. Crouch, Cincinnati, Ohio

[73] Assignee: The United States of America as represented by the Department of Health and Human Services, Washington, D.C.

[21] Appl. No.: 88

[22] Filed: Jan. 4, 1993

Related U.S. Application Data

[62] Division of Ser. No. 705,201, May 24, 1991, Pat. No. 5,176,566, which is a division of Ser. No. 397,226, Aug. 23, 1989, Pat. No. 5,027,694.

[51] Int. Cl.[5] ..... B08B 15/02

[52] U.S. Cl. ..... 454/56; 454/253

[58] Field of Search ..... 454/49, 56, 237, 253, 454/274, 278

[56] References Cited

U.S. PATENT DOCUMENTS

| | | | |
|---|---|---|---|
| 2,422,330 | 6/1947 | Allerdice . | |
| 3,378,076 | 4/1968 | Metler . | |
| 3,426,512 | 2/1969 | Nesher . | |
| 3,721,067 | 3/1973 | Agnew . | |
| 3,815,485 | 6/1974 | Beusink et al. | 454/338 |
| 3,948,154 | 4/1976 | Asakai et al. | 454/153 |
| 4,009,647 | 3/1977 | Howorth . | |
| 4,230,031 | 10/1980 | Pedroso et al. . | |
| 4,310,020 | 1/1982 | Jespersen et al. . | |
| 4,399,740 | 8/1983 | Zboralski . | |
| 4,399,741 | 8/1983 | Zboralski . | |
| 4,407,186 | 10/1983 | Izumi et al. . | |
| 4,412,849 | 11/1983 | Shahani . | |
| 4,434,711 | 3/1984 | Zboralski et al. . | |
| 4,517,883 | 5/1985 | Levchenko et al. . | |
| 4,528,898 | 7/1985 | Sharp et al. . | |
| 4,637,301 | 1/1987 | Shields . | |
| 4,676,144 | 6/1987 | Smith, III . | |
| 4,741,257 | 5/1988 | Wiggin et al. . | |
| 4,742,763 | 5/1988 | Holter et al. | 454/75 |

FOREIGN PATENT DOCUMENTS

| | | | |
|---|---|---|---|
| 369047 | 3/1932 | United Kingdom | 454/244 |

*Primary Examiner*—Harold Joyce

*Attorney, Agent, or Firm*—Lowe, Price, LeBlanc & Becker

[57] ABSTRACT

Methods and apparatus for controlling the flow of fluid around an object which include means to periodically vary or fluctuate the direction, speed or magnitude of the fluid flow. The fluid flow is particularly controlled to control eddy formation. The fluid is preferably a gas or vapor.

3 Claims, 3 Drawing Sheets

VARIABLE AIR FLOW EDDY CONTROL

This application is a Divisional, application, of application Ser. No. 07/705,201, filed May 24, 1991, now U.S. Pat. No. 5,176,566 which is a Divisional application of application Ser. No. 07/397,226, filed Aug. 23, 1989, now U.S. Pat. No. 5,027,694.

TECHNICAL FIELD

The present invention relates to apparatus and methods for controlling the flow of fluid around an object. In particular, the present invention relates to apparatus and methods for controlling the formation of eddies and the flow of fluid borne particles around an object located in a fluid flow path.

BACKGROUND ART

When working with various toxic and hazardous materials including radioactive samples and strong chemical components in laboratory or industrial conditions it is essential that care be taken to insure that such materials are safely contained so that persons working with these materials are protected from direct exposure to the materials or any toxic vapors or air borne particles generated by the handling of such materials. When working with relatively small to moderate samples of radioactive chemicals and other hazardous materials it has been the practice to provide a working area which is generally isolated from the surrounding environment.

In laboratory environments the containment or isolation of hazardous and toxic laboratory chemicals is generally accomplished by providing a work area which is enclosed or covered with a hood with access to the work area being permitted only by means of openings which allow a chemist or laboratory technician to extend their arms into the work area. Because the entry openings to such work stations also provide an avenue by which hazardous materials and fumes could escape or be vented to the surrounding area, it has been the practice to provide a positive air flow through the openings and into the work area. By creating a continuous ingress of air into the covered work area, airborne contaminants are prevented from escaping therefrom.

In most laboratory environments, harmful or hazardous materials are handled safely within a laboratory fume hood. The hood captures contaminants and prevents them from escaping into the laboratory by utilizing an exhaust blower to draw air and contaminants in and around the hood's work area away from the operator so that the inhalation of and contact with the contaminants or toxic components are minimized. Access to the interior of the hood is through one or more openings which are closed with a sash which typically slides up and down to vary the opening of the hood.

The velocity of air flow through the hood opening is called the face velocity. The more hazardous the material being handled, the higher the recommended face velocity. Guidelines have been established relating face velocity to toxicity. Generally, minimum face velocities for laboratory fume hoods are 75 to 150 feet per minute, depending on the application.

When the operator is working in the hood, the sash is open to allow free access to the materials inside. The sash may be open partially or fully, depending on the operations to be performed in the hood. While fume hood and sash sizes vary, the opening provided by the fully open sash is on the order of 10 square feet. Thus, the maximum air flow which the blower must provide is typically on the order of 750 to 1500 cubic feet per minute. The sash is closed when the hood is not being used by an operator. It is common to store hazardous or toxic materials inside a hood when the hood is not in use, and a positive air flow must therefore be maintained to exhaust contaminants from such materials even when the hood is not in use and a sash is closed.

In larger laboratory environments and particularly in industrial settings hazardous or toxic materials are often handled in such large quantities that they are handled in ventilated chambers, booths or walk-in exhaust hoods into which workers enter to work with and handle the hazardous or toxic materials. Such walk-in exhaust hoods, chambers and booths are conventionally utilized for such processes as paint spraying, welding, grinding, cutting, metallizing, drum filling operations and the like. It is estimated that there are about 50,000 walk-in exhaust hoods, chambers or booths used in the United States alone.

Efforts to insure proper ventilation and containment of hazardous or toxic materials when utilizing fume hoods or walk-in ventilated chambers or booths have generally focused on methods and apparatus which maintain constant positive air flow, methods and apparatus designed to regulate and vary ventilation air flow, methods and apparatus to create laminar air flow and various exhaust filtering systems to contain hazardous and toxic materials.

In spite of the advances made in controlling hazardous or toxic materials in fume hoods and walk-in ventilated work environments, there remains an unsolved problem associated with the formation of eddies as a result of the exhaust air flow through these work environments. An eddy is a feature of steady turbulent flow in which a circulating pattern develops downstream and adjacent to an obstacle. In a typical ventilation system, the eddy associated with a person will contribute to that person's exposure to gases, vapors or dust if these materials are released in the eddy. The circulating flow will carry the material back to the person's breathing zone.

Other obstacles will also have associated eddies which cause materials released downstream in a primary ventilating flow to be carried to upstream points. This effect is generally unintended and can decrease the ventilation system's effectiveness nearly to the point of negating it. In order to protect persons working in ventilated exhaust chambers, the formation of eddies needs to be controlled. Only by eliminating or reducing the strength of the eddy can a person experience the intended effect of a ventilating system and be insured of a contaminate free breathing zone.

The present invention is an improvement over prior known fume hoods, walk in ventilated work areas and the like which provides for highly effective ventilation by controlling and reducing eddy formation.

DISCLOSURE OF THE INVENTION

It is accordingly one object of the present invention to provide for fluid flow control around an object located in a stream of flowing fluid.

Another object of the present invention is to provide for means to periodically alter a property of a flowing fluid so as to control the flow of the fluid around an object.

A further object of the present invention is to provide for means to periodically vary the direction of flow of an exhaust fluid so as to control the flow of fluid around an object.

A still further object of the present invention is to provide for means to periodically vary the magnitude of velocity of a flowing fluid so as to control the flow of the fluid around an object.

An even further object of the present invention is to provide for means to control the formation of eddies and the flow of fluid borne particles around an object located in a fluid flow path.

In satisfaction of the above objectives, there is provided by the present invention an apparatus for controlling the flow of a fluid around an object which includes means to periodically vary a property of the flowing fluid. In particular, the present invention provides means for varying the direction of flow of at least a portion of the total fluid flow, means to periodically vary the magnitude of velocity of the flow of at least a portion of the total fluid stream, and a combination of these means.

The present invention further provides a method for controlling the flow of fluid around an object located in a stream of flowing fluid which involves periodically altering a property of the flowing fluid.

BRIEF DESCRIPTION OF THE DRAWINGS

The present invention will now be described with reference to the annexed drawings, which are given by way of non-limiting examples only in which.

BEST MODE FOR CARRYING OUT THE INVENTION

Figure 1:
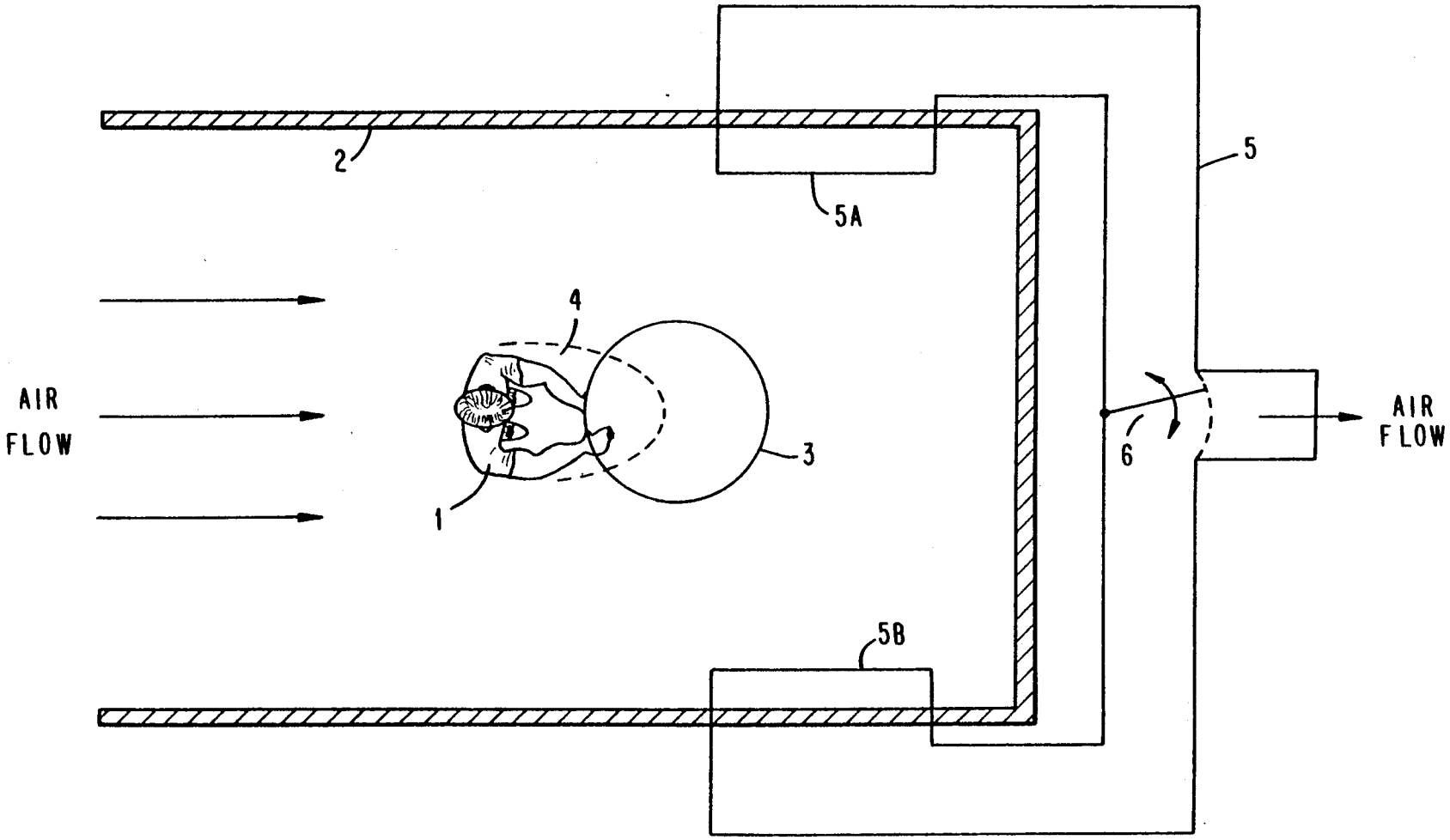
FIG. 1 is an illustration of an apparatus for controlling the direction of fluid flow according to one embodiment of the present invention.

The present invention covers a wide range of control systems for controlling fluid flow around objects. In particular, the present invention is directed to control systems which prevent or reduce eddy formation and control the flow of fluid borne particles around a stationary or moving object. Although particularly applicable to gases or vapors the fluid may also be applied to liquids and plasmas. The method of accomplishing the desired fluid control is to arrange for fluctuations in the flow of the fluid. These fluctuations consist of changes in either the speed or the direction of air flow or both.

The elements of the fluid flow control system, as will be discussed in detail below must be arranged so that the fluctuations occur at points in the flow where undesirable eddy formation may occur or where fluid borne particles come into contact with or pass around objects in the flow path. Location of the elements of the control system must be carefully arranged bearing in mind that fluctuations introduced at one point in the flow may or may not be experienced at other such points.

The amplitude and duration of the fluctuations introduced into the flow must be large enough to disrupt eddy formation or to appropriately control the flow of fluid borne particles. For example, if the speed of the flow is varied to control eddy formation, the air speed must be reduced at least to the point where circulating flow will cease for a long enough period for the circulating flow to cease. After this time, normal air flow can again be resumed until the eddy formation begins. Since this eddy formation process is not instantaneous, but takes some time to develop, the timing of the fluctuations must be adjusted appropriately to control eddy formation. Similarly, air direction changes introduced to control eddy formation require minimum magnitudes and durations in order to be effective.

In one embodiment of the present invention fluctuations in the flow properties of the fluid can be generated by applying a flow of supplementary air into the region of eddy formation by means of a fan or blower, for example, and associated duct work. Such supplementary fan or blower is then operated in such a manner so that its applied air flow is varied in speed or direction for the purpose of eddy suppression.

Other, and more preferred, embodiments of the present invention rely upon means which periodically alter or fluctuate a property of the flowing fluid which are located either at a fluid flow inlet, a fluid flow outlet or a combination of a fluid flow inlet and outlet of the chamber. Additionally, it has been found that one or more fluid flow inlets and one or more fluid flow outlets can be utilized advantageously to control or suppress eddy formation and to control the flow of fluid borne particulates around an object located in a ventilated chamber.

In one embodiment the present invention is directed to an apparatus for controlling the flow of a fluid stream around an object which includes means to periodically vary the direction of flow of at least a portion of the total fluid stream. This controlled portion of the fluid stream may be the entire fluid stream or any smaller portion thereof. Particular means utilized to vary the direction of flow include means to selectively vent the flow of at least a portion of the total fluid stream in at least two directions. In a more preferred embodiment the fluid flow is contained in a chamber and the means to selectively vent at least a portion of the total fluid stream includes an exhaust system having at least two inlets connected to the chamber and a valve means that alternately and periodically connects each of the inlets between the chamber and a common exhaust conduit. In another embodiment, as more fully discussed below, two exhaust inlets are connected on opposing sides of the chamber, adjacent one end thereof.

In one embodiment of the present invention the means to periodically vary the direction of flow of the fluid includes means to vary the cross sectional area of a fluid flow inlet through which the fluid enters the chamber. In particular, a sliding or pivoting member is arranged to be movably positionable across the cross-sectional opening of the fluid inlet such that a suitable mechanical control means can periodically slide, pivot or otherwise move the member across the cross-sectional opening of the fluid inlet thereby effectively changing the direction of flow as the fluid enters the chamber. Alternately, such a control means may be located at a fluid flow outlet or at both the fluid flow inlet and fluid flow outlet in order to control and periodically vary the flow direction of the fluid within the chamber.

In a preferred embodiment, a sliding member is mounted in a suitable track adjacent the fluid flow inlet and connected with a mechanical means which periodically slides the member back and forth across the cross-sectional opening of the fluid flow inlet.

In addition to controlling eddy formation and the flow of fluid borne particles by periodically changing the direction of flow of the fluid, it has been discovered that such control can be effected by periodically varying the magnitude of velocity of flow of at least a portion of the total fluid stream. Accordingly, in a further embodiment of the present invention the formation or suppression of eddies and the flow of fluid borne particulates is controlled by periodically varying the magnitude of velocity of the fluid by suitable venting means. In particular, it has been found that venting fluid flow from a chamber in a fluctuating manner can effectively control fluid flow around an object.

Accordingly, in one embodiment of the present invention an evacuation chamber is supplied with an exhaust conduit which is connected by a control valve to a suitable vacuum source such as a fan. To effectuate fluctuations in the exhaust, the control valve is also connected to a damper and includes means for alternately connecting the vacuum source to either the exhaust conduit of the chamber or the damper. Alternately, appropriate fluctuations in the magnitude of the flow of the fluid could be accomplished by including a blower connected in a similar manner to the fluid inlet of the chamber which could apply fluctuating flow pressure to the chamber. Finally, a combination of applying fluctuating pressure and fluctuating vacuum to the chamber is possible according to the present invention.

In general, in accordance with the above features of the present invention, the present invention is directed to a method of controlling fluid flow around an object located in a stream of flowing fluid which includes periodically altering a property of the fluid such as flow direction, flow speed and combinations of these properties.

FIG. 1 illustrates one embodiment of the present invention in which air direction fluctuations are utilized to control eddy formation. In FIG. 1, worker 1 is illustrated as being located in ventilated booth 2 adjacent a source of contaminants 3 which typically generate a wake of eddies 4 downstream of the worker. If the wake of eddies intersects the contaminate source at a downstream distance from the worker of less than the eddy diameter, backflow of the contaminants will occur, causing the exposure of the worker to these contaminants.

To eliminate eddy formation, the exhaust system 5 illustrated in FIG. 1 is constructed with two exhaust inlets, 5A and 5B, which connect to opposed walls of booth 2 adjacent one end thereof. Valve 6, located within exhaust system 5 as illustrated, alternately connects the air flow from one inlet to the other thereby periodically changing the direction of air flow near the point where the eddy formation occurs in the booth. In accordance with the present invention air flow in FIG. 1 can be achieved either by creating a pressure upstream of booth 2 or, more preferably, creating a lower pressure downstream of booth 2 within the exhaust system 5. The optimum period for oscillation of valve 6 is somewhat dependent on the particular installation but, in a representative example according to the present invention a period of about 4 seconds was found to be sufficient to disrupt and suppress eddy formation.

As illustrated in FIG. 1 valve 6 may be any type of valve which can be suitably controlled by a conventional motor, solenoid or the like. Preferably, valve 6 is a flapper type valve which operates periodically to connect and disconnect between exhaust inlets 5A and 5B.

Figure 2:
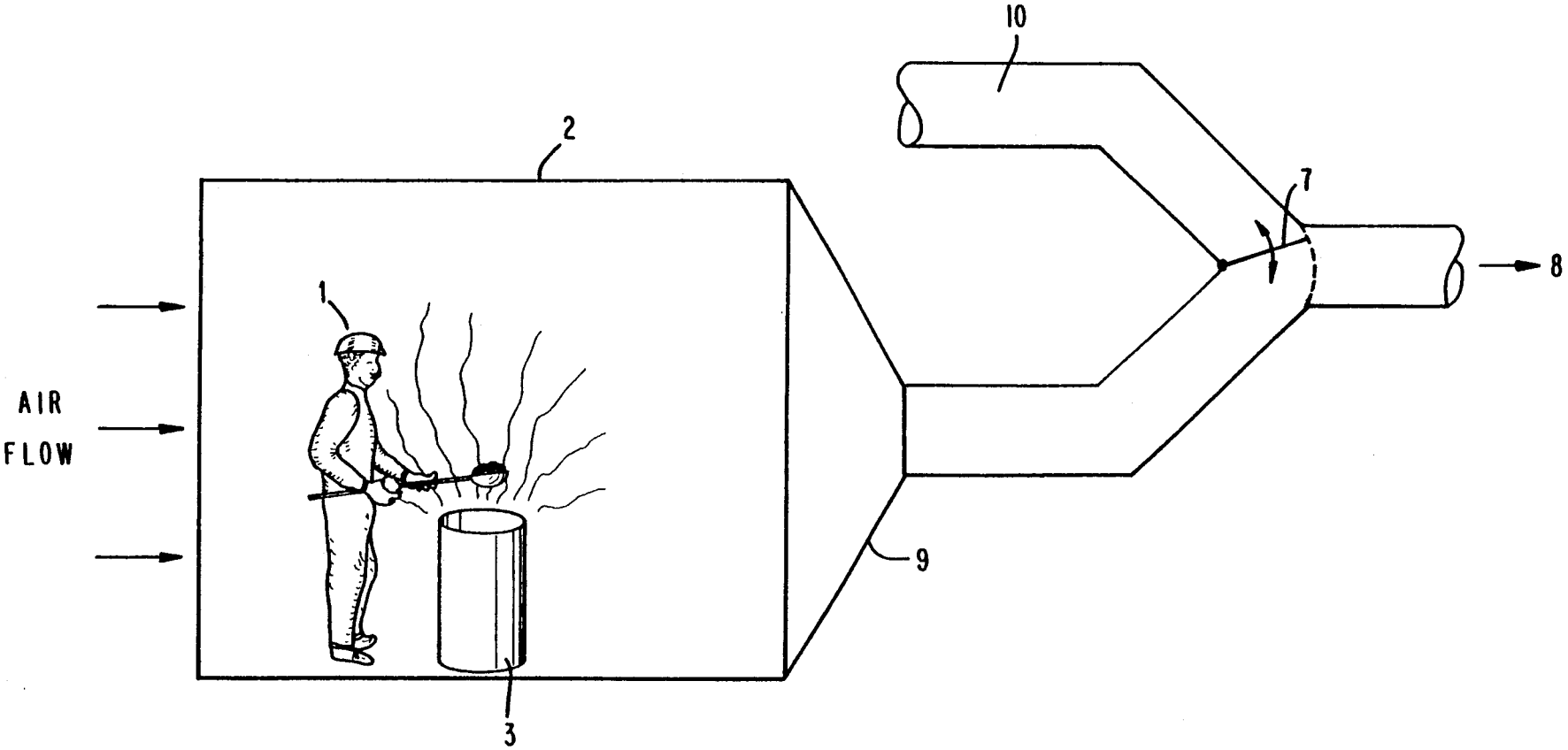
FIG. 2 is an illustration of an apparatus for controlling the magnitude of the fluid flow according to a second embodiment of the present invention.

FIG. 2 illustrates another embodiment of the present invention in which air speed fluctuations are utilized for eddy control. As illustrated in FIG. 2 flapper valve 7 is moved to connect exhaust blower 8 in order to withdraw air from hood 9 located at one end of chamber 2. Flapper valve 7 is controlled by suitable flapper drive mechanism and timed so that when eddy formation begins near worker 1, flapper 7 is moved to a lower position as illustrated. The air flow to hood 9 then stops and air is pulled instead through damper 10. When circulating air currents in the hood cease, the cycle is repeated. In a representative example, the cycle requires a period of about 4 seconds in order to effectively control eddy formation within chamber 2.

When utilizing more than one chamber, the leg of ventilating system ending in damper 10 could be connected to a second hood if desired. Moreover, any number of chambers could be utilized with a single exhaust system provided that suitable valve means were included to periodically and alternately connect with each chamber at the necessary frequency.

Whereas FIG. 2 illustrates an embodiment in which air speed fluctuations are effected by connecting the chamber to a suitable exhaust pressure, similar air speed fluctuations could be accomplished by providing chamber 2 with an alternating air flow pressure upstream of worker 1. Additionally, a combination of both alternating air speed pressure upstream and air exhaust means downstream are possible by the present invention.

A particular feature associated with the embodiment illustrated in FIG. 2 of the present system is that particles carried into the exhaust system beyond the flapper valve will experience a steady flow which will carry them to the exhaust outlet, whereas a simple on/off valve at the position of a flapper would cause a zero air flow condition once every cycle that would allow particles to settle instead of being carried out, as desired. Also, the damper can be adjusted to minimize exhaust flow fluctuations downstream of the flapper valve.

Figure 3:
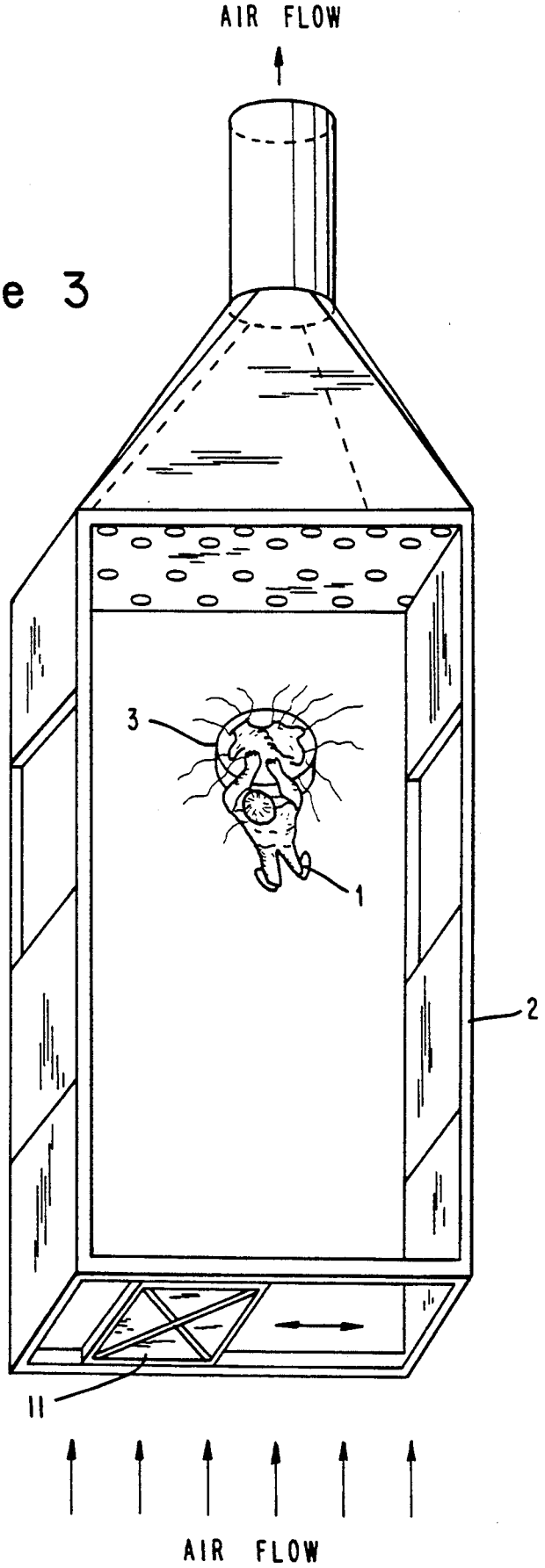
FIG. 3 is an illustration of a further embodiment of the present invention in which the fluid flow direction or the fluid flow gradient is controlled according to one embodiment of the present invention.

FIG. 3 illustrates a further embodiment of the present invention in which air flow fluctuations are introduced at an upstream point by sliding panel 11 which is located at the entrance to booth 2. The panel is attached to guide members which permit it to slide from one wall of the booth to the other as illustrated. An actuating mechanism is also attached to the panel which automatically moves it from one wall to the other with a suitable period, which in an exemplary embodiment is about 4 seconds. Any suitable panel width may be utilized, however, a panel width of one half of the width of the booth openings has been found to be particularly useful according to the present invention.

At the position of worker 1, the air flow changes direction as panel 11 slides from one side of the booth to the other, this fluctuation in air flow direction disrupts the eddy formation process which would otherwise carry fluid borne material from the contaminate source 3 back to the worker 1 as the worker approaches the source to within an eddy diameter.

Other mechanisms could be substituted for a sliding panel, such as oscillating louvers or a large rotating flap which would serve the same purpose of causing the air flow to change directions periodically at the worker's location.

A similar arrangement could be made at an opposite end of chamber 2 in which sliding panel 11 could be utilized to control the position in which air flow is exhausted out of chamber 2. Moreover, a combination of sliding panels at opposite ends of chamber 2, i.e. at an air flow inlet end and an air flow exhaust end could be utilized to effectively control air flow direction and thus enable control of eddy formation.

The illustrations presented above show a booth and a hood enclosing the worker and the contaminant source. However, the principles of the present invention apply equally to unenclosed situations in which a ventilating air flow interacts with a person adjacent to a source of air borne contaminants. Also, if only the contaminant source is enclosed but the person is outside the enclosure as, for example, in a typical laboratory exhaust hood, the same phenomenon of eddy formation occurs and can pull air borne contaminants out of the hood. Therefore, the principle of introducing air fluctuations would also control eddies associated with laboratory fume hoods and in unenclosed ventilating situations.

Although the invention has been described with reference to particular means, materials and embodiments, from the foregoing description, one skilled in the art can ascertain the essential characteristics of the present invention and various changes and modifications may be made to adapt the various uses and characteristics thereof without departing from the spirit and scope of the present invention as described in the claims that follows.

I claim:

1. An apparatus for controlling the flow of a fluid stream around an object which comprises a chamber in which said object is located, means to draw a flowing stream through said chamber, and means to periodically vary the direction of flow of at least a portion of the total fluid stream, in such a manner so as to prevent the formation of eddies in said fluid stream in the vicinity of said object, said means to periodically vary the direction of flow comprising means to vary the cross-sectional area of a fluid port through which said fluid flow is drawn.

2. An apparatus for controlling the flow of a fluid stream according to claim 1, wherein said means to vary the cross-sectional area comprises a member which is movably mounted such that said member may be moved across said fluid flow outlet.

3. An apparatus for controlling the flow of a fluid stream according to claim 2, wherein said member is slidingly mounted such that said member may be periodically slid across said fluid flow inlet.

* * * * *